United States Patent [19]

Braun et al.

[11] Patent Number: 4,984,762

[45] Date of Patent: Jan. 15, 1991

[54] REAR DRAWER SLIDE FRAME MOUNTING SCREW WITH ADJUSTABLE POSITION COMPRESSION SPRING

[76] Inventors: Thomas F. Braun; Manfred H. Braun, both of 250 Jackson Ave., Mineola, N.Y. 11501

[21] Appl. No.: 346,631

[22] Filed: May 3, 1989

[51] Int. Cl.[5] ..... E04G 3/00

[52] U.S. Cl. ..... 248/216.1; 267/177; 312/245; 411/389

[58] Field of Search ..... 248/216.1, 216.4, 217.4, 248/546, 578, 575; 411/389; 312/245, 270; 267/177, 175, 179

[56] References Cited

U.S. PATENT DOCUMENTS

| | | | |
|---|---|---|---|
| 2,571,568 | 10/1951 | Greenup . | |
| 2,663,608 | 12/1953 | Schauer . | |
| 2,667,399 | 1/1954 | Swimmer . | |
| 3,528,718 | 9/1970 | Johnson et al. | 312/270 X |
| 3,550,979 | 12/1970 | Protzmann | 312/183 |
| 4,257,193 | 3/1981 | Williams | 49/465 |

*Primary Examiner*—Carl D. Friedman
*Assistant Examiner*—Daniel Hulseberg
*Attorney, Agent, or Firm*—Fleit, Jacobson, Cohn, Price, Holman & Stern

[57] ABSTRACT

A system is provided for mounting the rear end of a bracket assembly within a cabinet between the front and rear walls of the cabinet and wherein the horizontal distance between the front and rear walls of the cabinet may vary. The rear end of the bracket assembly includes front-to-rear extending guide sleeves supported therefrom and support pins are longitudinally slidably received through the sleeves. The front ends of the pins include rotary torque input structure whereby rotary torque may be applied to the pins through the utilization of a rotary torque tool and the rear ends of the pins include threaded blind bores in which forward ends of screw shanks are removably threadedly engaged, the rear ends of the screw shanks being equipped with wood screw threads. In addition, the rear ends of the pins include abutment structures supported therefrom for adjustment longitudinally therealong and compression springs are disposed on the pins between the abutment structure and the sleeves through which the pins are slidably received.

6 Claims, 1 Drawing Sheet

REAR DRAWER SLIDE FRAME MOUNTING SCREW WITH ADJUSTABLE POSITION COMPRESSION SPRING

BACKGROUND OF THE INVENTION

1. Field of the Invention

The present invention relates to a bracket-type slide frame assembly for slidably mounting a support structure within a cabinet including a face or front wall having an opening therein and a rear wall opposing the face wall and with the assembly mounted within the cabinet immediately above the aforementioned opening and from which a support is slidably mounted for movement through the opening between a recessed position within the cabinet and an exposed position disposed at least substantially forward of the cabinet front wall opening.

2. Description of the Related Art

U.S. Pat. No. 3,528,718 discloses a bracket assembly of the same general type as the bracket assembly of the instant invention and which is mounted within an associated cabinet in generally the same manner. However, the bracket assembly of the instant invention includes structural improvements relating to the manner in which the bracket assembly is mounted within the associated cabinet to provide a more secure mounting of the bracket assembly within the cabinet and to enable the bracket assembly to be easily removed from the cabinet for servicing adjacent equipment or structure and the bracket assembly to be thereafter reinstalled within the cabinet.

SUMMARY OF THE INVENTION

The bracket assembly of the instant invention has been specifically designed to facilitate ease of mounting of the bracket assembly within a kitchen cabinet or the like through a door opening formed in the front wall of the cabinet. Further, the bracket assembly is constructed in a manner enabling its mounting within cabinets of different depths. Also, the bracket assembly is mounted within an associated cabinet in a manner such that it may be readily removed therefrom and, thereafter, reinstalled with little effort.

The main object of this invention is to provide a bracket assembly which may be readily mounted within a kitchen cabinet or the like through a door opening formed in the front wall of the cabinet and with the bracket assembly being constructed in a manner to slidingly support a support therefrom for movement through the cabinet door opening.

Another object of this invention is to provide a bracket assembly constructed in a manner for ease of installation within cabinets of different depths.

Yet another object of this invention is to provide a bracket assembly which may be readily removed from and thereafter readily reinstalled within an associated cabinet.

Still another object of this invention is to provide a bracket assembly including mounting structure functioning to provide a secure mounting of the bracket assembly within an associated cabinet.

A final object of this invention to be specifically enumerated herein is to provide a bracket assembly in accordance with the preceding objects and which will conform to conventional forms of manufacture, be of simple construction and easy to install so as to provide a device that will be economically feasible, long-lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
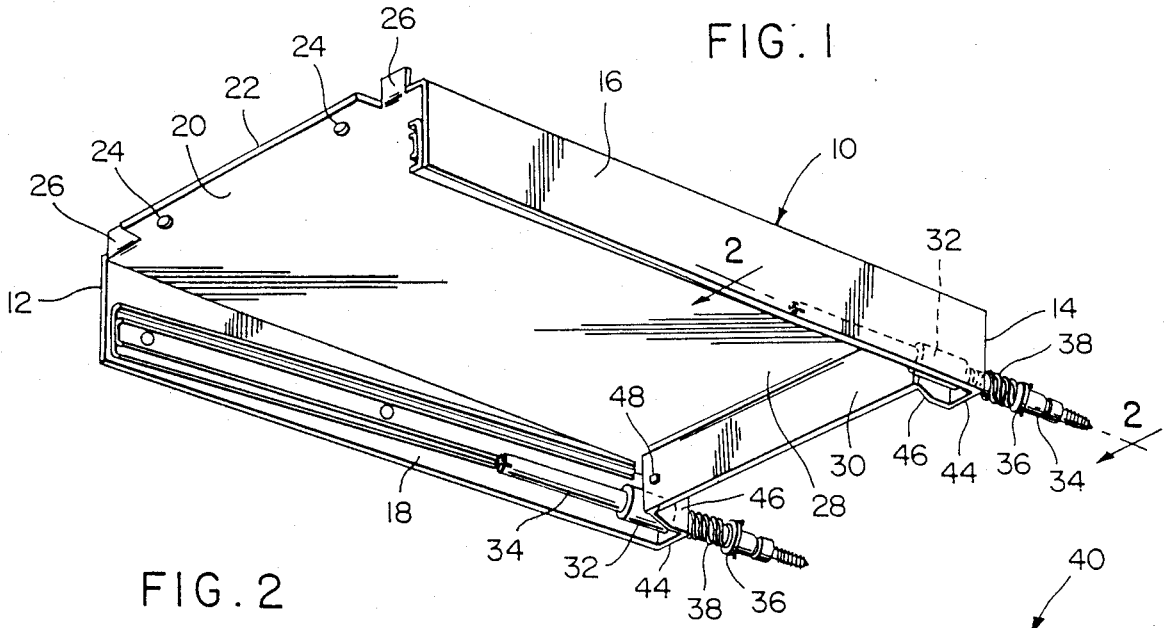
FIG. 1 is a bottom perspective view of the bracket assembly of the instant invention.

Referring now more specifically to the drawings, the bracket assembly of the instant invention is referred to in general by the reference numeral 10 and includes front and rear ends 12 and 14. The bracket assembly 10 incorporates a pair of opposite side, elongated, laterally spaced and front-to-rear extending upstanding flanges 16 and 18 interconnected by an integral front-to-rear extending web 20 extending between and interconnecting the upper margins of the flanges 16 and 18.

The front margin 22 of the web 20 includes a pair of apertures 24 formed therethrough and the opposite ends of the front margin 22 include upturned abutment tabs 26, the apertures 24 being spaced slightly inward of the abutment tabs 26.

The rear margin 28 of the web 20 includes an integral depending flange 30 and opposite side portions of the rear end 14 of the bracket assembly 10 includes front-to-rear extending guide sleeves 32 supported therefrom through which elongated and front-to-rear extending mounting pins 34 are guidingly slidable and rotatably received. Abutment washers 36 are mounted upon the pins 34 and partially compressed compression springs 38 are disposed on the mounting pins 34 between the guide sleeves 32 and the abutment washers 36.

Figure 2:
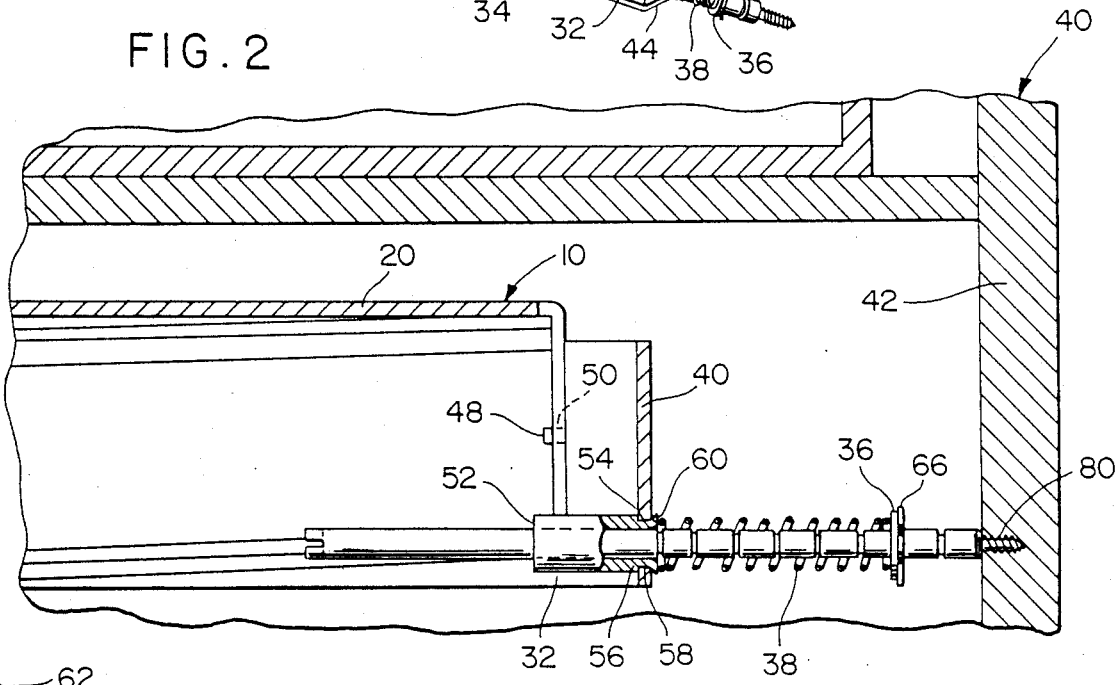
FIG. 2 is an enlarged fragmentary vertical sectional view of the rear portion of the bracket assembly and illustrating the manner in which the bracket assembly rear portion is anchored relative to the rear wall of a cabinet.
Figure 3:
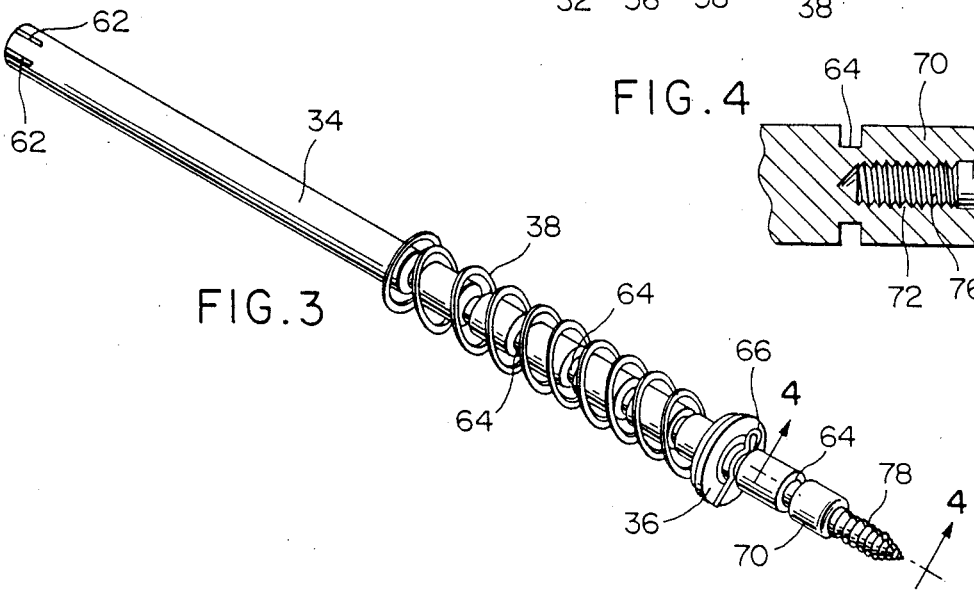
FIG. 3 is an enlarged perspective view of one of the mounting pins of the mounting bracket.
Figure 4:
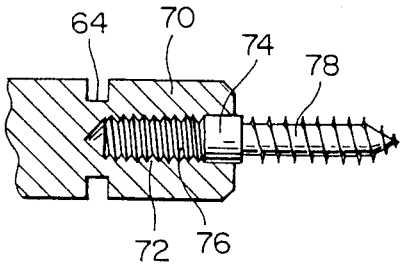
FIG. 4 is an enlarged fragmentary sectional view taken substantially upon the plane indicated by the section line 4—4 of FIG. 3.

With attention now invited more specifically to FIG. 2, the reference numeral 40 generally designates a cabinet including a rear wall 42, a front or face wall (not shown) is disposed to the left of the rear wall 42 illustrated in FIG. 2 and has an opening formed therein having an upper horizontal margin substantially horizontally registered with the upper surface of the horizontal web 20 of the bracket assembly 10 illustrated in FIG. 2.

The foregoing description of the bracket assembly 10 and cabinet 40 corresponds directly to the cabinet (36) and bracket assembly (62) disclosed in U.S. Pat. No. 3,528,718 and the structure disclosed in U.S. Pat. No. 3,528,718 is incorporated herein by reference thereto.

The bracket assembly 10, however, differs from the bracket assembly (62) in that the rear ends of the flanges 16 and 18 include integral inwardly directed transverse flange portions 44 which in turn terminate inwardly in forwardly directed flange portions 46, the free forward ends of the flange portions 46 being abutted against the rear surface of the downwardly directed flange 30 and including anchor tabs 48 received through openings 50 provided therefor in the flange 30 with the anchor tabs 48 being bent over the inner or forward surfaces of the flange 30.

The guide sleeves 32 include slightly flared forward ends 52 and the rear ends of the guide tubes 32 include diametrically reduced end portions 54 defining rearwardly facing shoulders 56. The diametrically reduced rear ends 54 are rearwardly received through and extend beyond openings 58 formed in the flange portions 44 and those portions of the rear ends 54 projecting rearwardly of the flange portions 44 are flared over as at 60 to anchor the guide sleeves 32 relative to the flange portions 44.

The mounting pins 34 include crossed screw driver blade receiving slots 62 in their forward ends and the rear ends of the pins 34 include longitudinally spaced circumferentially extending grooves 64 formed therein in which spring clips 66 are selectively removably engageable, the washers 36 being disposed about the pins 34 immediately forward of the spring clips 66. Further, the rear terminal ends 70 of the pins 34 are provided with threaded axial blind bores 72, and mounting shanks 74 include first forward machine screw threaded ends 76 removably threadedly engaged in the blind bores 72 and opposite wood screw threaded rear ends 78 which project outwardly beyond the terminal ends 70.

The apertures 24 receive wood screws or the like upwardly therethrough in order to secure the front margin 22 of the web to the underside of that portion of the front wall of the cabinet 40 defining the opening therein with the forward facing sides of the abutment tabs 26 abuttingly engaged with the inner surface of the front wall immediately above the opening. The wood screw threaded rear ends of the mounting shanks 74 are threaded into the rear wall 42 as at 80 and in this manner the bracket assembly 10 is securely mounted within the cabinet 40. In the event the bracket assembly 10 is mounted within an undersink cabinet and must be removed in order to perform service upon undersink equipment such as drain pipes and/or a garbage disposal unit, the screws secured through the apertures 24 are removed and the pins 34 are unscrewed from the machine threaded ends 76 of the mounting shanks 74, thereby allowing the wood screw threaded rear ends 78 of the mounting shanks 74 to remain undisturbed in their threaded engagement with the rear wall 42. Of course, after maintenance or repair has been performed on the undersink equipment, the bracket assembly 10 may be readily reinstalled in position merely by threading the terminal ends 70 onto the machine threaded ends 76 and reapplying the wood screws previously secured through the apertures 24.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bracket assembly for a slidable support, said bracket assembly being adapted for support in a cabinet structure including a closed upper extremity, an upright face wall having an access opening therein terminating upwardly at a level below said upper extremity and a rear wall opposite said face wall, the upper limit of said opening being defined by an upper portion of said face wall, said bracket assembly having front and rear margins and including a pair of horizontally elongated, laterally spaced and front-to-rear extending upstanding flanges having corresponding front and rear ends, connecting means extending between and interconnecting upper marginal portions of said flanges, said front margin including means for support from said upper portion of said face wall, said rear margin including a pair of front-to rear extending sleeves, a pair of elongated front-to-rear extending pins slidably and rotatably received through said sleeves, said pins including rear ends having threaded shank means projecting endwise outwardly therefrom for threaded engagement in said rear wall and the front ends of said pins including rotary torque input means adapted to have a rotary torque tool drivingly engaged therewith, a compression spring disposed on each pin between the corresponding sleeve and threaded shank means, each pin including anchor location means spaced therealong and an anchor member selectively removably engageable with a selected anchor location means, each spring being at least slightly compressed between the corresponding anchor member and the adjacent end of the corresponding sleeve.

2. The bracket assembly of claim 1 wherein each of said threaded shank means comprises an elongated shank member having front and rear ends, said front end being machine screw threaded, said rear end being wood screw threaded, said rear ends of said pins having machine screw threaded blind bores therein, said machine screw threaded front ends being removably threadedly engaged in said blind bores.

3. The bracket assembly of claim 1 wherein said rotary torque input means includes a screw driver shank end engageable recess formed in said front end of each pin.

4. A bracket assembly for mounting within a cabinet between face and rear walls of said cabinet, said bracket assembly having front and rear margins and incorporating a pair of horizontally elongated, laterally spaced and front-to-rear extending upstanding flanges having corresponding front and rear ends, a web extending between and interconnecting upper marginal portions of said flanges, said front margin including means for support from said face wall, said web, adjacent said rear margin, including a depending flange, said rear ends of said upstanding flanges projecting rearwardly of said depending flange and terminating rearwardly in inturned flange portions, a pair of front-to-rear extending guide sleeves secured through said inturned flange portion, a pair of front-to-rear extending support pins slidably received through said guide sleeves and having rear ends including threaded shank members for threaded engagement in said rear wall, abutment means carried by the rear ends of said mounting pins rearward of said sleeves, and compression springs disposed on said pins intermediate said abutment means and sleeves, each pin including anchor location means spaced therealong and an anchor member selectively removable engageable with a selected anchor location means, the front ends of said pins including rotary torque input means adapted to have a rotary torque tool drivingly engaged therewith, said rear ends of said support pins including machine screw threaded blind bores formed therein, said threaded shank members including machine screw threaded forward ends removably threadedly engaged in said blind bores.

5. The bracket assembly of claim 4 wherein said rear ends of said pins include longitudinally spaced abutment member anchor means thereon, said abutment means of each mounting pin comprising an abutment member removably engaged with a selected corresponding abutment member anchor means.

6. An elongated mounting pin having front and rear ends and adapted to have a longitudinal mid-portion thereof slidably received through a guide sleeve carried by at least a portion of a member to be supported from said guide pin, said front end of said pin including rotary torque input means adapted to have a rotary torque tool drivingly engaged therewith, the rear end of said pin including an endwise outwardly opening threaded blind bore formed therein, a mounting shank including front and rear ends, said front end of said mounting shank being machine screw threaded and removably threaded in said blind fore, the rear end of said shank being wood screw threaded and being adapted to be threaded into a support for said guide pin rear end wherein said rear end of said pin includes longitudinally spaced circumferentially extending grooves formed therein, a spring clip member removably engageable in one of said grooves, a washer slidably disposed on said pin forward of said spring clip, and a compression spring disposed about said pin forward of said washer and adapted to be axially compressed between said washer and an adjacent end of said sleeve.

* * * * *